US008406662B2

(12) United States Patent
Maeda

(10) Patent No.: US 8,406,662 B2
(45) Date of Patent: Mar. 26, 2013

(54) DEVELOPER SUPPLY DEVICE

(75) Inventor: Masataka Maeda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 336 days.

(21) Appl. No.: 12/731,422

(22) Filed: Mar. 25, 2010

(65) Prior Publication Data

US 2010/0247134 A1 Sep. 30, 2010

(30) Foreign Application Priority Data

Mar. 31, 2009 (JP) ..... 2009-087384

(51) Int. Cl.
*G03G 15/08* (2006.01)

(52) U.S. Cl. ..... 399/281; 399/291

(58) Field of Classification Search ..... 399/281, 399/265, 266, 272, 289, 290, 291
See application file for complete search history.

(56) References Cited

U.S. PATENT DOCUMENTS

| | | | | |
|---|---|---|---|---|
| 7,099,611 | B2 | 8/2006 | Aoki et al. | |
| 2003/0118376 | A1* | 6/2003 | Adachi et al. | 399/265 |
| 2004/0223792 | A1 | 11/2004 | Aoki et al. | |
| 2007/0031169 | A1* | 2/2007 | Hirahara et al. | 399/265 |
| 2007/0086811 | A1* | 4/2007 | Tsukamoto et al. | 399/265 |
| 2007/0147904 | A1* | 6/2007 | Maeda | 399/265 |
| 2009/0175662 | A1* | 7/2009 | Nishiwaki | 399/281 |

FOREIGN PATENT DOCUMENTS

| | | | |
|---|---|---|---|
| JP | 63-013066 | A | 1/1988 |
| JP | 11-084862 | A | 3/1999 |
| JP | 2002-287484 | A | 10/2002 |
| JP | 2003-098826 | | 4/2003 |
| JP | 2004-279880 | A | 10/2004 |
| JP | 2004-280068 | A | 10/2004 |
| JP | 2006-259203 | A | 9/2006 |
| JP | 2007-133376 | | 5/2007 |
| JP | 2010-224467 | A | 10/2010 |
| WO | 2008066016 | A1 | 6/2008 |

* cited by examiner

*Primary Examiner* — Walter L Lindsay, Jr.
*Assistant Examiner* — Rodney Bonnette
(74) *Attorney, Agent, or Firm* — Banner & Witcoff, Ltd.

(57) ABSTRACT

A developer supply device, comprising: a casing; first electrodes located at a first most downstream position defining a certain distance with respect to the supply target and positions between the casing and the first most downstream position to form a first traveling electric field; a second electrodes that are located at a second most downstream position defining the certain distance with respect to the supply target and positions between the casing and the second most downstream position to form a second traveling electric field; a power circuit that supplies a first voltage and a second voltage having a same frequency respectively to the first electrodes and the second electrodes such that a phase of voltage change of a first most downstream electrode and a phase of voltage change of a second most downstream electrode shift with respect to each other.

14 Claims, 10 Drawing Sheets

DEVELOPER SUPPLY DEVICE

CROSS-REFERENCE TO RELATED APPLICATION

This application claims priority under 35 U.S.C. §119 from Japanese Patent Application No. 2009-087384, filed on Mar. 31, 2009. The entire subject matter of the application is incorporated herein by reference.

BACKGROUND

1. Technical Field

Aspects of the present invention relate to a developer supply device for supplying a charged powdery developer to a supply target.

2. Related Art

Recently, developer supply devices configured to carry a developer to a supply target through a traveling electric field have been proposed. In the developer supply device, a toner carrying substrate on which a plurality of electrodes is arranged is located between a toner box and a photosensitive body. By applying pulse voltages whose phases are shifted with respect to each other to the plurality of electrodes of the carrying substrate, the traveling electric field is generated on the carrying substrate, and thereby the toner is carried along the carrying substrate toward the photosensitive body.

SUMMARY

In the toner supply device, to an electrode (a facing electrode) facing the photosensitive body, a voltage (a repulsion voltage) generating coulomb force for attracting the toner to the photosensitive body and a voltage (an attracting voltage) generating coulomb force for attracting the toner toward the electrode are alternately applied. While the attracting voltage is applied to the facing electrode, the toner on the facing electrode moves to a part of an outer circumferential surface of the photosensitive body where the outer circumferential surface of the photosensitive drum faces the facing electrode. On the other hand, while the repulsion voltage is applied to the facing electrode, the toner does not move to the outer circumferential surface of the photosensitive drum.

However, it should be noted that the outer circumferential surface of the photosensitive drum moves while the attracting voltage is applied to the facing electrode. Therefore, a part of the outer circumferential surface of the photosensitive body facing the facing electrode when the attracting voltage is applied to the facing electrode moves away from the facing electrode when the next repulsion voltage is applied to the facing electrode. In this case, to the part of the outer circumferential surface of the photosensitive body, the toner is not supplied. As a result, unevenness in the amount of toner like a stripe pattern may be caused on the outer circumferential surface of the photosensitive body.

Aspects of the present invention are advantageous in that a developer supply device capable of reducing unevenness in the amount of toner, such as unevenness in a form of stripes, caused on a supply target is provided.

According to an aspect of the invention, there is provided a developer supply device for supplying a developer to a supply target, comprising: a casing that stores the developer; a first plurality of electrodes that are located at a first most downstream position and positions between the casing and the first most downstream position to form a first traveling electric field to carry the developer toward the supply target, the first most downstream position being located to have a predetermined distance with respect to the supply target; a second plurality of electrodes that are located at a second most downstream position and positions between the casing and the second most downstream position to form a second traveling electric field to carry the developer toward the supply target, the second most downstream position being located to have the predetermined distance with respect to the supply target; a power circuit that supplies a first voltage and a second voltage respectively to the first plurality of electrodes and the second plurality of electrodes such that a phase of voltage change of a first most downstream electrode of the first plurality of electrodes located at the first most downstream position and a phase of voltage change of a second most downstream electrode of the second plurality of electrodes located at the second most downstream position shift with respect to each other, the voltage change of the first voltage and the voltage change of the second voltage have a same frequency.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
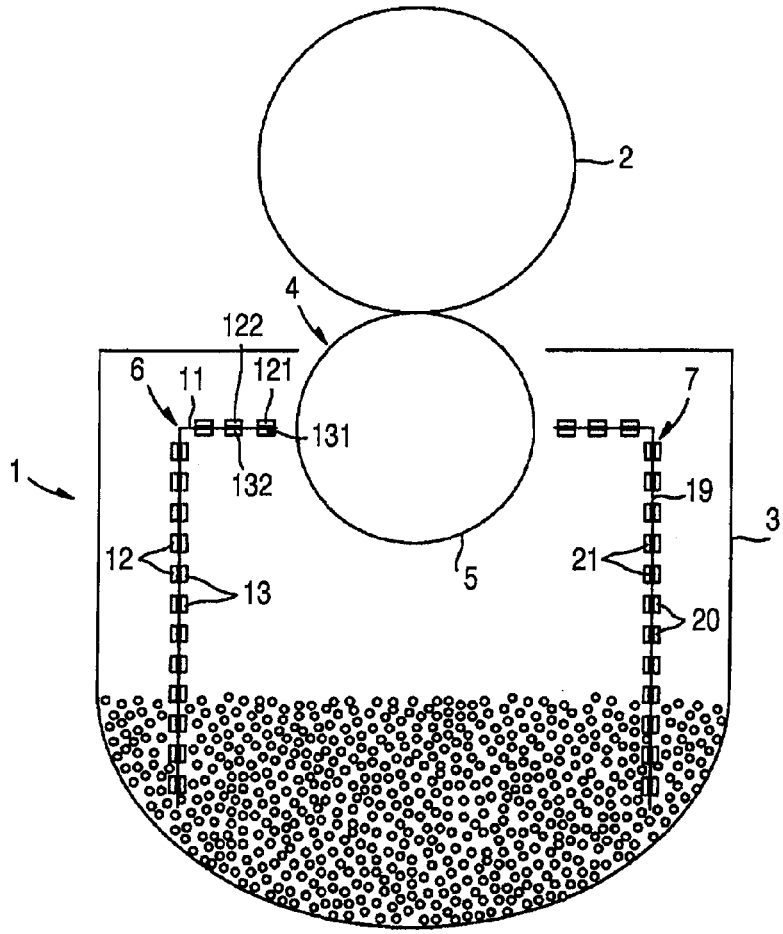
FIG. 1 is a cross section illustrating a configuration of a toner supply device according to a first embodiment.

As shown in FIG. 1, a toner supply device 1 is provided in an image forming device (e.g., a printer, a copying device and a multifunction peripheral) to supply a developer to a photosensitive drum 2 on which an electrostatic latent image is formed. The toner supply device 1 has a casing 3 which stores the developer. The developer is, for example, powdery toner which has a positive electrostatic property and is single component toner having a nonmagnetic property.

In the top surface of the casing 3, a rectangular opening 4 is formed. Further, a development roller 5 (a supply target) is provided to seal the opening 4. More specifically, the development roller 5 is arranged such that a rotation axis of the development roller 5 is oriented along the lengthwise direction of the opening 4, and a part of the development roller 5 is exposed to the outside of the casing 3 through the opening 4. Furthermore, a part of an outer circumferential surface of the development roller 5 exposed to the outside contacts an outer circumferential surface of the development roller 2. The development roller 5 may be grounded. That is, in this case, 0V is applied to the development roller 5.

In the image forming device, the outer circumferential surface of the photosensitive drum 2 is charged uniformly (e.g., at −500V) so that a predetermined potential difference is generated between the photosensitive drum 2 and the development roller 5. By selectively irradiating the outer circumferential surface of the photosensitive drum 2, an electrostatic latent image is formed on the outer circumferential surface of the photosensitive drum 2. When the electrostatic latent image faces the development roller 5 by rotation of the photosensitive drum 2, the toner is supplied to the electrostatic latent image through the potential difference between the electrostatic latent image and the development roller 5. As a result, the electrostatic latent image is developed with the toner, i.e., a toner image is formed. Furthermore, by transferring the toner image from the outer circumferential surface of the photosensitive drum 2 to a sheet of paper directly or via an intermediate transfer belt (not shown), an image is formed on the sheet of paper.

The toner is stored in a bottom portion of the casing 3. In the casing 3, a member (e.g., an agitator (not shown)) which stirs the toner stored in the bottom portion of the casing to positively charge the developer is provided. Further, in the casing 3, a toner carrying substrate 6 which carries the toner stored in the bottom portion of the casing 3 to the developer 5 and a toner collecting substrate 7 which collects undesired toner from the outer circumferential surface of the development roller 5 are provided.

The toner carrying substrate 6 is formed to extend upward from the bottom portion of the casing 3 and to bend to extend in the horizontal direction so that an end thereof faces the development roller 5. By applying a voltage to the toner carrying substrate 6, a traveling electric field is generated along the toner carrying substrate 6. Through the traveling electric field, the toner stored in the bottom portion of the casing 3 is carried to the development roller 5. The toner which has carried to the development roller 5 is then moves from the toner carrying substrate 6 to the outer circumferential surface of the development roller 5. As described above, the toner is supplied to the outer circumferential surface of the development roller 5, and a thin layer of the toner is held on the outer circumferential surface of the development roller 5. A configuration of the toner carrying substrate 6 is explained in detail later.

The toner collecting substrate 7 is arranged on the opposite side of the toner carrying substrate 6 with respect to the development roller 5. The toner collecting substrate 7 may be formed such that a proximal end portion thereof extends in the horizontal direction with respect to the outer circumferential surface of the development roller 5, and is bent downward to extend toward the bottom portion of the casing 3. The toner collecting substrate 7 has the same internal configuration as that of the toner carrying substrate 6. By applying a voltage to the toner collecting substrate 7, the toner moves from the development roller 5 to the toner collecting substrate 7 through the potential difference between the development roller 5 and the toner collecting substrate 7. Furthermore, through the traveling electric field generated along the toner collecting substrate 7, the toner is carried toward the bottom portion of the casing 3. As described above, the toner is collected from the development roller 5 to the bottom portion of the casing 3.

Figure 2:
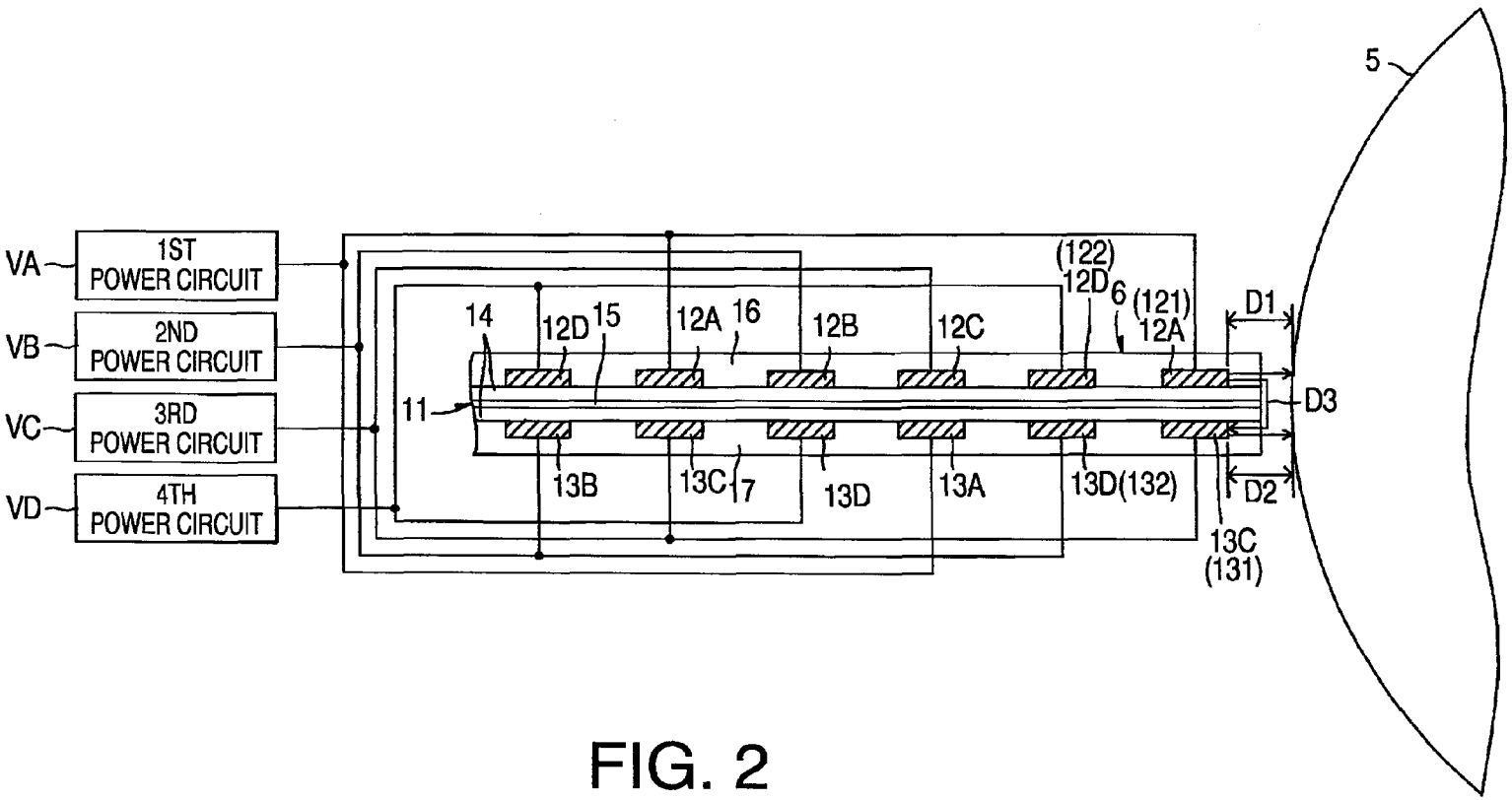
FIG. 2 is a cross section of a toner carrying substrate illustrating an internal configuration thereof with a configuration for voltage application to the toner carrying substrate.

As shown in FIG. 2, the toner carrying substrate 6 has a support substrate 11, a plurality of electrodes 12 arranged on one side of the support substrate 11, and a plurality of electrodes 13 arranged on the other side of the support substrate 11. The support substrate 11 is formed such that a shield layer 15 formed of an conductive material, such as metal, is sandwiched between two insulating resin layers 14 formed of an insulating material, such as polyimide. The support substrate 11 has a width larger than the width of the development roller 5 in the axial direction, and is formed to extend along the longer side in the direction perpendicular to the width direction. The shield layer 15 is grounded. Therefore, an electric field is not generated to bridge the both sides of the shield layer 15.

Each of the electrodes 12 is formed of a thin copper film, and is formed to have a rectangular shape extending in the direction (i.e., the axial direction of the development roller 5) perpendicular to the longitudinal direction of the support substrate 11. The electrodes 12 are arranged on one of the resin layers 14 to have constant intervals along the longitudinal direction of the support substrate 11. That is, the electrodes 12 are arranged to form a stripe pattern.

A predetermined distance D1 (linear dimension) is secured between the outer circumferential surface of the development roller 5 and one of the electrodes 12 (hereafter, referred to as a most downstream electrode 121) located at the most downstream position in a toner transport direction. On the resin layer 14, a coating layer 16 having a smooth upper face is formed. That is, the electrodes 12 are coated with the coating layer 16.

A (first) power circuit VA is connected to the most downstream electrode 121 and the electrodes 12 arranged at intervals of four electrodes from the most downstream electrode 121. A (second) power circuit VB is connected to the third electrode 12 located at third position with respect to the most downstream electrode 121 and the electrodes 12 arranged at intervals of four electrodes from the third electrode 12. A (third) power circuit VC is connected to the second electrode 12 located at second position with respect to the most downstream electrode 121 and the electrodes 12 arranged at intervals of four electrodes from the second electrode 12. A (fourth) power circuit VD is connected to the first electrode 12 located adjacent to the most downstream electrode 121 and the electrodes 12 arranged at intervals of four electrodes from the first electrode 12.

Each of the electrodes 13 is formed of a thin copper film, and is formed to have a rectangular shape extending in the direction (i.e., the axial direction of the development roller 5) perpendicular to the longitudinal direction of the support substrate 11. The electrodes 13 are arranged on the other resin layer 14 to have constant intervals along the longitudinal direction of the support substrate 11. That is, the electrodes 13 are arranged on the opposite resin layer 14 of the resin layer 14 on which the electrodes 12 are formed. The electrodes 13 are arranged to form a stripe pattern.

A predetermined distance D2 (linear dimension) which is equal to the distance D1 is secured between the outer circumferential surface of the development roller 5 and one of the electrodes 13 (hereafter, referred to as a most downstream electrode 131) located at the most downstream position in the toner transport direction. On the resin layer 14, a coating layer 17 having a smooth upper face is formed. That is, the electrodes 13 are coated with the coating layer 17.

Preferably, each of the coating layers 16 and 17 is formed of material having a relatively low friction resistance with respect to the toner. For example, each of the coating layers 16 and 17 may be formed of polyimide.

The distance D1 (D2) is smaller than a distance D3 defined, between the most downstream electrode 121 and the most downstream electrode 131, along the direction of the electric field generated when a voltage is applied to the most downstream electrodes 121 and 131.

The power circuit VC is connected to the most downstream electrode 131 and the electrodes 13 arranged at intervals of four electrodes from the most downstream electrode 131. The power circuit VD is connected to the third electrode 13 located at third position with respect to the most downstream electrode 131 and the electrodes 13 arranged at intervals of four electrodes from the third electrode 13. The power circuit VA is connected to the second electrode 13 located at the second position with respect to the most downstream electrode 131 and the electrodes 13 arranged at intervals of four electrodes from the second electrode 13. The power circuit VB is connected to the first electrode 13 located adjacent to the most downstream electrode 131 and the electrodes 13 arranged at intervals of four electrodes from the first electrode 13.

The toner collecting substrate 7 is configured such that a plurality of electrodes 20 and a plurality of electrodes 21 are provided at constant intervals on both sides of the support substrate 19. That is, the toner collecting substrate 7 has the same internal configuration as that of the toner carrying substrate 6. Therefore, explanations of the toner collecting substrate 7 will not be repeated.

Hereafter, if it is necessary to explain the electrodes 12 while distinguishing the electrode 12 connected to the power circuit VA, the electrode 12 connected to the power circuit VB, the electrode 12 connected to the power circuit VC and the electrode 12 connected to the power circuit VD with respect to each other, the electrode 12 connected to the power circuit VA is referred to as an electrode 12A, the electrode 12 connected to the power circuit VB is referred to as an electrode 12B, the electrode 12 connected to the power circuit VC is referred to as an electrode 12C and the electrode 12 connected to the power circuit VD is referred to as an electrode 12D. If it is necessary to explain the electrodes 13 while distinguishing the electrode 13 connected to the power circuit VA, the electrode 13 connected to the power circuit VB, the electrode 13 connected to the power circuit VC and the electrode 13 connected to the power circuit VD with respect to each other, the electrode 13 connected to the power circuit VA is referred to as an electrode 13A, the electrode 13 connected to the power circuit VB is referred to as an electrode 13B, the electrode 12 connected to the power circuit VC is referred to as an electrode 13C and the electrode 12 connected to the power circuit VD is referred to as an electrode 13D.

Figure 3:
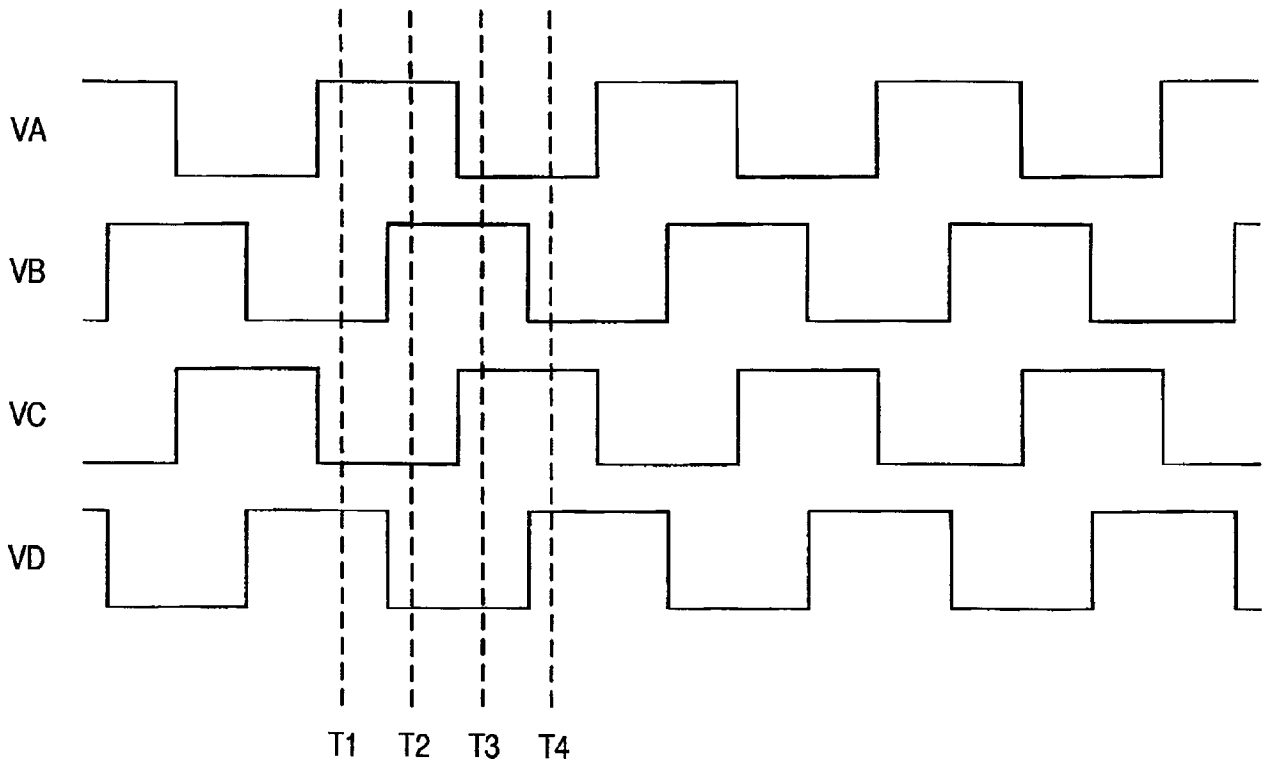
FIG. 3 is a timing chart illustrating waveforms of output signals of power circuits.

As shown in FIG. 3, each of the power circuits VA, VB, VC and VD generates a pulse signal of which voltage amplitude alternately changes between the minimum value and the maximum value. The frequency of the pulse signal is, for example, 300 Hz. The minimum value and the maximum value of the pulse signal are, for example, 0V and 200V, respectively.

The phase of the pulse signal generated by the power circuit VB delays by 90 degrees with respect to the pulse signal generated by the power circuit VA. The phase of the pulse signal generated by the power circuit VC delays by 90 degrees with respect to the pulse signal generated by the power circuit VB, and delays by 180 degrees with respect to the pulse signal generated by the power circuit VA. In other words, the pulse signal generated by the power circuit VC changes in a reversed phase relationship with respect to the pulse signal generated by the power circuit VA.

The phase of the pulse signal generated by the power circuit VD delays by 90 degrees with respect to the pulse signal generated by the power circuit VC. The phase of the pulse signal generated by the power circuit VC delays by 90 degrees with respect to the pulse signal generated by the power circuit VB, and delays by 180 degrees with respect to the pulse signal generated by the power circuit VB. In other words, the pulse signal generated by the power circuit VD changes in a reversed phase relationship with respect to the pulse signal generated by the power circuit VB.

With this configuration, the phase of the voltage change of each of the most downstream electrode 121 (12A) and the electrodes 12A located at (4×n)-th positions with respect to the most downstream electrode 121 has an inversed phase relationship with the phase of the voltage change of each of the most downstream electrode 131 (13C) and the electrodes 13C located at (4×n)-th positions with respect to the most downstream electrode 131.

The phase of each of the voltage change of the third electrode 12B located at the third position with respect to the most downstream electrode 121 and the voltage changes of the electrodes 12B located at (4×n)-th positions with respect to the third electrode 12B has an inversed phase relationship with the phase of each of the voltage change of the third electrode 13D located at the third position with respect to the most downstream electrode 121 and the electrodes 13D located at (4×n)-th positions with respect to the third electrode 12D.

The phase of each of the voltage change of the second electrode 12C located at the second position with respect to the most downstream electrode 121 and the voltage changes of the electrodes 12C located at (4×n)-th positions with respect to the second electrode 12C has an inversed phase relationship with the phase of each of the voltage change of the second electrode 13A located at the second position with respect to the most downstream electrode 131 and the electrodes 13A located at (4×n)-th positions with respect to the second electrode 13A.

Furthermore, the phase of each of the voltage change of the first electrode 12D located adjacent to the most downstream electrode 121 and the voltage changes of the electrodes 12D located at (4×n)-th positions with respect to the first electrode 12D has an inversed phase relationship with the phase of each of the voltage change of the first electrode 13B located adjacent to the most downstream electrode 131 and the electrodes 13B located at (4×n)-th positions with respect to the first electrode 13B.

Hereafter, carrying of the toner by the toner carrying substrate 6 is explained with reference to FIGS. 4A, 4B, 4C and 4D. In the following, the minimum value and the maximum value of the pulse signal are defined as 0V and 200V, respectively.

By applying the pulse signals from the power circuits VA, VB, VC and VD to the electrodes 12, a traveling electric field is generated on the electrodes 12. Through the traveling electric field, the positively charged toner is carried on the coating layer 16 from the bottom portion of the casing 3 toward the development roller 5.

Furthermore, by applying the pulse signals from the power circuits VA, VB, VC and VD to the electrodes 13, a traveling electric field is generated on the electrodes 13. Through the traveling electric field, the positively charged toner is carried on the coating layer 17 from the bottom portion of the casing 3 toward the development roller 5.

More specifically, as shown in FIG. 3, at the time T1, 200V is applied to the electrodes 12A and 13A connected to the power circuit VA, 0V is applied to the electrodes 12B and 13B connected to the power circuit VB, 0V is applied to the electrodes 12C and 13C connected to the power circuit VC, and 200V is applied to the electrodes 12D and 13D connected to the power circuit VD.

Figure 4A:
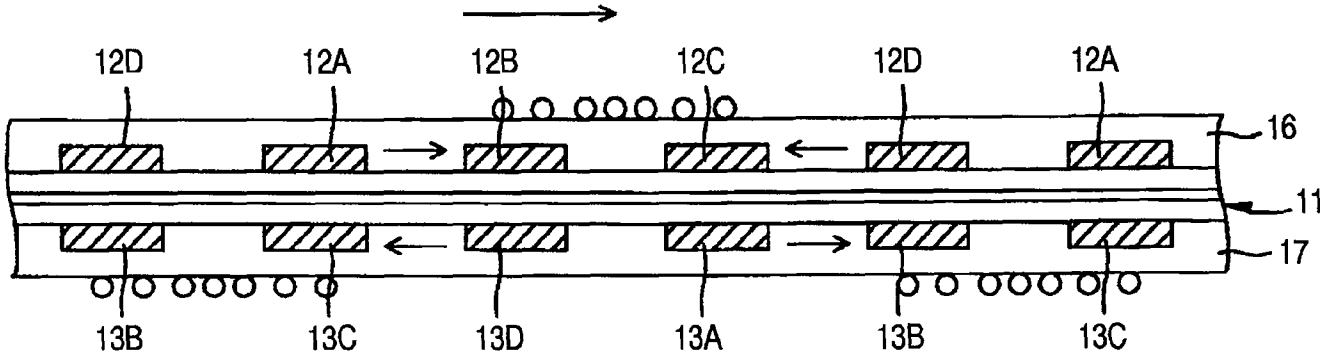
FIGS. 4A, 4B, 4C and 4D are explanatory illustrations for explaining carrying of toner by the toner carrying substrate.

As a result, at the time T1, an electric field having the direction pointing from the electrode 12A to the electrode 12B is generated between the electrodes 12A and 12B as shown in FIG. 4A. Furthermore, an electric field having the direction pointing from the electrode 12D to the electrode 12C is generated between the electrodes 12C and 12D as shown in FIG. 4A. As a result, through coulomb force applied from the electric field, the toner on the coating layer 16 gathers at a portion between the electrodes 12B and 12C.

As the time T2, 200V is applied to the electrodes 12A and 13A, 200V is applied to the electrodes 12B and 13B, 0V is applied to the electrodes 12C and 13C, and 0V is applied to the electrodes 12D and 13D.

Figure 4B:
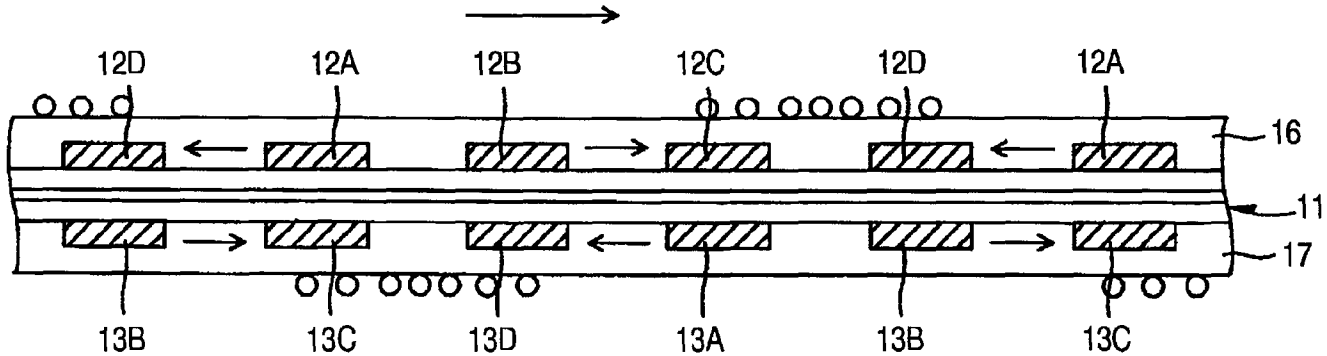

As a result, at the time T2, an electric field having the direction pointing from the electrode 12A to the electrode 12D is generated between the electrodes 12A and 12D as shown in FIG. 4B. Furthermore, an electric field having the direction pointing from the electrode 12B to the electrode 12C is generated between the electrodes 12B and 12C as shown in FIG. 4B. As a result, through coulomb force applied from the electric field, the toner which has gathered on the coating layer 16 between the electrodes 12B and 12C moves to the side of the development roller 5, and gathers at a portion between the electrodes 12C and 12D.

Furthermore, at the time T2, an electric field having the direction pointing from the electrode 13A to the electrode 13D is generated between the electrodes 13A and 13D as shown in FIG. 4B. Furthermore, an electric field having the direction pointing from the electrode 13B to the electrode 13C is generated between the electrodes 13B and 13C as shown in FIG. 4B. As a result, through coulomb force applied from the electric field, the toner which has gathered on the coating layer 17 between the electrodes 13B and 13C moves to the side of the development roller 5, and gathers at a portion between the electrodes 13C and 13D.

At the time T3, 0V is applied to the electrodes 12A and 13A, 200V is applied to the electrodes 12B and 13B, 200V is applied to the electrodes 12C and 13C, and 0V is applied to the electrodes 12D and 13D.

Figure 4C:
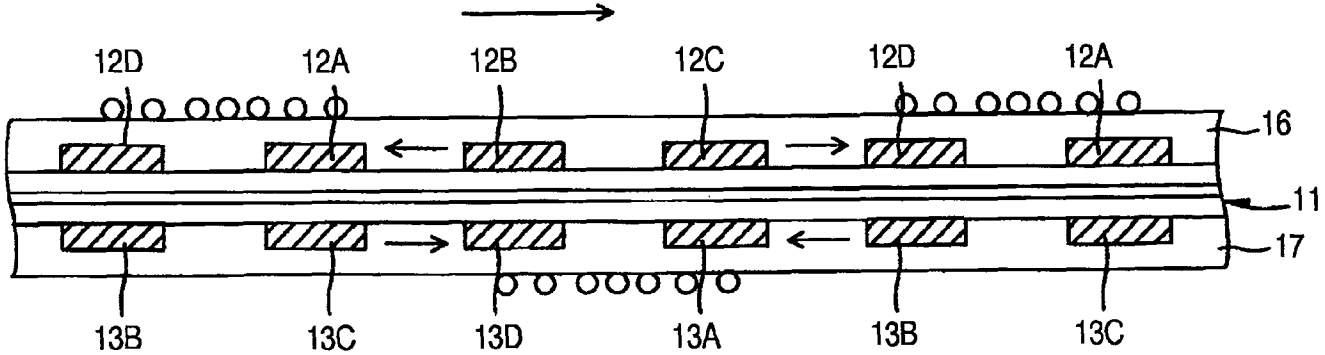

As a result, at the time T3, an electric field having the direction pointing from the electrode 12B to the electrode 12A is generated between the electrodes 12A and 12B as shown in FIG. 4C. Furthermore, an electric field having the direction pointing from the electrode 12C to the electrode 12D is generated between the electrodes 12C and 12D as shown in FIG. 4C. As a result, through coulomb force applied from the electric field, the toner which has gathered on the coating layer 16 between the electrodes 12C and 12D moves to the side of the development roller 5, and gathers at a portion between the electrodes 12A and 12D.

Furthermore, at the time T3, an electric field having the direction pointing from the electrode 13B to the electrode 13A is generated between the electrodes 13A and 13B as shown in FIG. 4C. Furthermore, an electric field having the direction pointing from the electrode 13C to the electrode 13D is generated between the electrodes 13C and 13D as shown in FIG. 4C. As a result, through coulomb force applied from the electric field, the toner which has gathered on the coating layer 17 between the electrodes 13C and 13D moves to the side of the development roller 5, and gathers at a portion between the electrodes 13A and 13D.

At the time T4, 0V is applied to the electrodes 12A and 13A, 0V is applied to the electrodes 12B and 13B, 200V is applied to the electrodes 12C and 13C, and 200V is applied to the electrodes 12D and 13D.

Figure 4D:
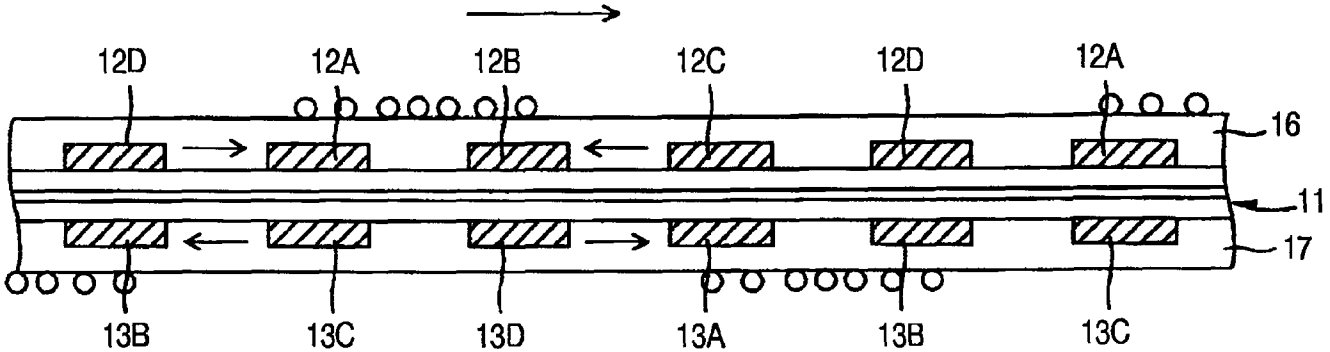

As a result, at the time T4, an electric field having the direction pointing from the electrode 12D to the electrode 12A is generated between the electrodes 12A and 12D as shown in FIG. 4D. Furthermore, an electric field having the direction pointing from the electrode 12C to the electrode 12B is generated between the electrodes 12B and 12C as shown in FIG. 4D. As a result, through coulomb force applied from the electric field, the toner which has gathered on the coating layer 16 between the electrodes 12A and 12D moves to the side of the development roller 5, and gathers at a portion between the electrodes 12A and 12B.

Furthermore, at the time T4, an electric field having the direction pointing from the electrode 13D to the electrode 13A is generated between the electrodes 13A and 13D as shown in FIG. 4D. Furthermore, an electric field having the direction pointing from the electrode 13C to the electrode 13B is generated between the electrodes 13B and 13C as shown in FIG. 4D. As a result, through coulomb force applied from the electric field, the toner which has gathered on the coating layer 17 between the electrodes 13A and 13D moves to the side of the development roller 5, and gathers at a portion between the electrodes 13A and 13B.

As described above, in the toner supply device 1, the traveling electric fields are generated on the electrodes 12 and the electrodes 13. The toner stored in the casing 3 is carried to the most downstream electrodes 121 and 131 through the electric fields. The toner carried to the most downstream electrodes 121 and 131 moves from the most downstream electrodes 121 and 131 to the circumferential surface of the development roller 5 when the voltage (e.g., 200V) for applying coulomb force attracting the toner toward the development roller 5 is applied to the most downstream electrode 121 and the most downstream electrode 131.

The phase of the voltage change of the most downstream electrode 121 has an inversed relationship with the phase of the voltage change of the most downstream electrode 131. Therefore, while the minimum voltage (e.g., 0V) of the pulse signal is applied to the most downstream electrode 121, 200V is applied to the most downstream electrode 131. On the other hand, while 0V is applied to the most downstream electrode 131, 200V is applied to the most downstream electrode 121. Therefore, during the time period in which the toner is not supplied from the most downstream electrode 121 to the development roller 5, the toner is supplied from the most downstream electrode 131 to the development roller 5. On the other hand, during the time period in which the toner is not supplied from the most downstream electrode 131 to the development roller 5, the toner is supplied from the most downstream electrode 121 to the development roller 5. As a result, it becomes possible to uniformly supply the toner to the outer circumferential surface of the development roller 5. Consequently, unevenness of the toner (e.g., a stripe pattern of toner) is prevented from occurring on the outer circumferential surface of the development roller 5.

When 200V is applied to the most downstream electrode 121, an electric field (hereafter, referred to as a first electric field) is formed by the voltage difference between the most downstream electrode 121 and the development roller 5. When 200V is applied to the most downstream electrode 131, an electric field (hereafter, referred to as a second electric field) is formed by the voltage difference between the most downstream electrode 131 and the development roller 5. When 200V is applied to one of the most downstream electrodes 121 and 131 and 0V is applied to the other of the most downstream electrodes 121 and 131, an electric field (hereafter, referred to as an electrode-electrode electric field) is generated by the voltage difference between the most downstream electrodes 121 and 131.

In the toner supply device 1, the distance D1 between the most downstream electrode 121 and the development roller 5 and the distance D2 between the most downstream electrode 131 and the development roller 5 are smaller than the distance D3 defined between the most downstream electrodes 121 and 131 along the electric field therebetween. The maximum amplitudes of the pulse signals applied to the electrodes 12 and the electrodes 13 are 200V, and the potential of the development roller 5 is 0V. Therefore, the strength of the first electric field and the strength of the second electric field are larger than the strength of the electrode-electrode electric field. Therefore, when 200V is applied to one of the most downstream electrodes 121 and 131 and 0V is applied to the other of the most downstream electrodes 121 and 131, movement of the toner between the most downstream electrodes 121 and 131 does not occur, and therefore it becomes possible to suitably supply the toner from the most downstream electrodes 121 and 131 to the development roller 5.

As described above, the electrodes 12 are arranged on one side of the support substrate 11 and the electrodes 13 are arranged on the other side of the support substrate 11. In addition, the support substrate 11 is provided such that one end of the support substrate 11 faces the development roller 5 and that the support substrate 11 extends from the one end to the opposite side with respect to the development roller 5. Furthermore, the most downstream electrodes 121 and 131 are arranged to face with each other while sandwiching the support substrate 11 therebetween. With this configuration, the distance D1 and the distance D2 become necessarily equal to each other.

As described above, in the support substrate 11, the shield layer 15 which is grounded is provided between the two resin layers 14. Therefore, the electrode 12 can be insulated from the electrode 13. As a result, it becomes possible to prevent an undesired electric field from being generated between the electrode 12 and the electrode 13. Furthermore, it becomes possible to prevent the traveling electric field from being deteriorated by the undesired electric field. Consequently, the developer can be carried suitably through the traveling electric field.

As described above, the toner collecting substrate 7 is provided in the toner supply device 1. By applying voltage signals similar to the voltage signals applied to the electrodes 12 and 13, to the electrodes 20 and the electrodes 21 of the toner collecting substrate 7, traveling electric fields are respectively formed on the electrodes 20 and the electrodes 21. The unnecessary toner, which has not been supplied to the photosensitive drum 2 and thereby remains on the outer circumferential surface of the development roller 5, is attracted to the toner collecting substrate 7, and is carried to the casing 3 along the toner collecting substrate 7. Therefore, it is possible to suitably collect the unnecessary toner into the casing 3.

Second Embodiment

Figure 5:
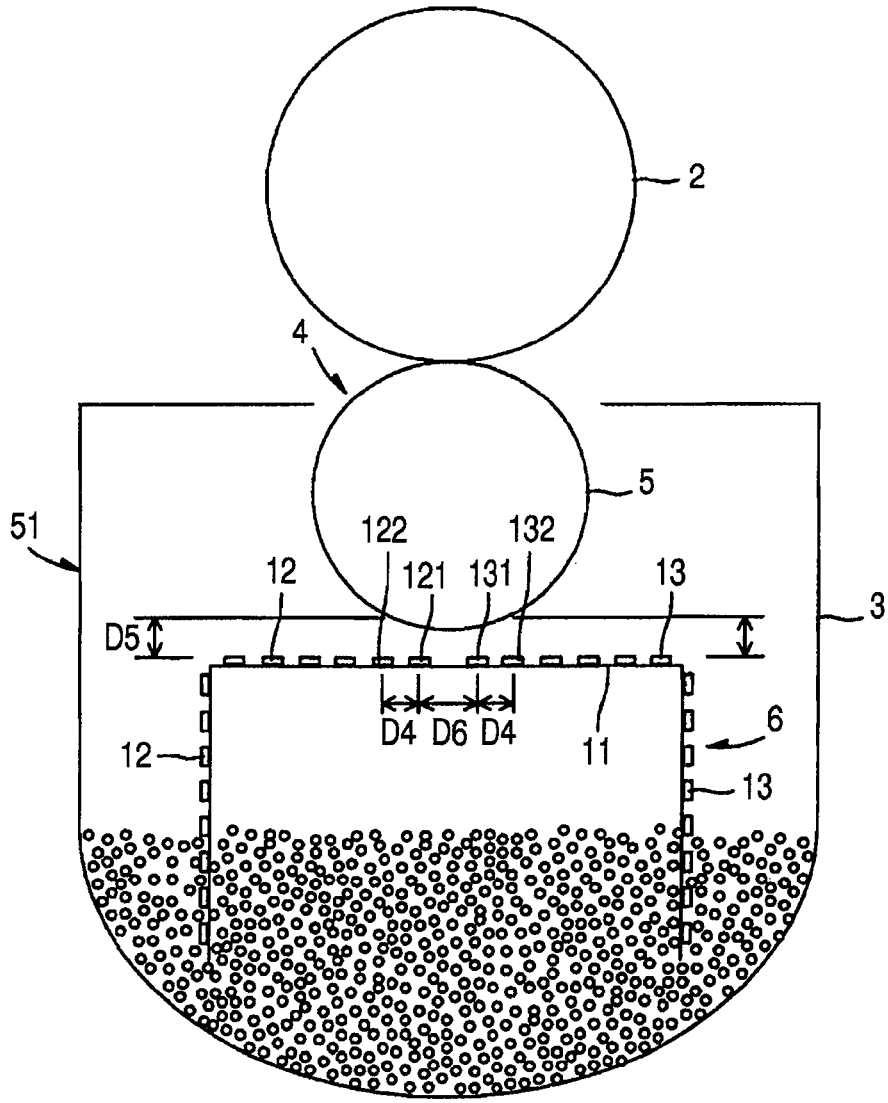
FIG. 5 is a cross section illustrating a configuration of a toner supply device according to a second embodiment.

Hereafter, a toner supply device 51 according to a second embodiment is explained with reference to FIG. 5. In FIG. 5, to elements which are substantially the same as those of the first embodiment shown in FIG. 1, the same reference numbers are assigned, and explanations thereof will not be repeated for the sake of simplicity. In the following, the explanation focuses on the feature of the second embodiment.

As shown in FIG. 5, in the toner supply device 51, the toner collecting substrate 7 is not provided. The support substrate 11 of the toner carrying substrate 6 is formed to extend upward from the bottom portion of the casing 3, to bend in the horizontal direction at the middle portion thereof to extend under the development roller 5, and to further bend downward so that an end of the support substrate 11 reaches the bottom portion of the casing 3.

The electrodes 12 are arranged at constant intervals on the outer surface of the support substrate 11, and the electrodes 13 are also arranged at constant intervals on the outer surface of the support substrate 11. The most downstream electrodes 121 and 131 are arranged at the most downstream position of the electrodes 12 and the most downstream position of the electrodes 13 which are symmetrical with respect to a line defined as the shortest distance between the development roller 5 and the support substrate 11. In addition, the electrodes 12 are arranged at constant intervals D4 between the bottom portion of the casing 3 and the most downstream position of the electrodes 12, and the electrodes 13 are arranged at constant intervals D4 between the bottom portion of the casing 3 and the most downstream position of the electrodes 13.

By positioning the most downstream electrodes 121 and 131 at positions which are symmetric with respect to the line defined as the shortest distance between the support substrate 11 and the development roller 5, the distance D1 between the most downstream electrode 121 and the development roller 5 necessarily becomes equal to the distance D2 between the most downstream electrode 131 and the development roller 5.

The distance D4 is smaller than a distance D5 between each of adjacent electrodes 122 and 132 and the outer circumferential surface of the development roller 5. Therefore, when a voltage (e.g., 200V) for generating coulomb force attracting the toner toward the development roller 5 is applied to the adjacent electrodes 122 and 132, the toner can be suitably carried from the adjacent electrode 122 to the most downstream electrode 121 and the toner can be suitably carried from the adjacent electrode 132 to the most downstream electrode 131 without causing movement of the toner from the adjacent electrodes 122 and 132 to the development roller 5.

Furthermore, the distance D6 between the most downstream electrodes 121 and 131 is larger than the distance D4. Therefore, movement of the toner between the most downstream electrodes 121 and 131 does not occur.

It should be noted that since FIG. 5 and other similar drawings are illustrated for the purpose of explanation, dimensions of some parts (e.g., electrodes) in these drawings are slightly exaggerated. Practically, the most downstream electrodes 121 and 131 are located sufficiently close to each other so that the toner is supplied to substantially the same position on the outer circumferential surface of the development roller 5 from both of the most downstream electrodes 121 and 131.

According to the second embodiment, it is possible to achieve the same advantages as those of the first embodiment, excepting the advantage provided by the toner collecting substrate 7.

However, it should be understood that the toner supply device 51 may be configured to have the toner collecting substrate 7.

Third Embodiment

Figure 6:
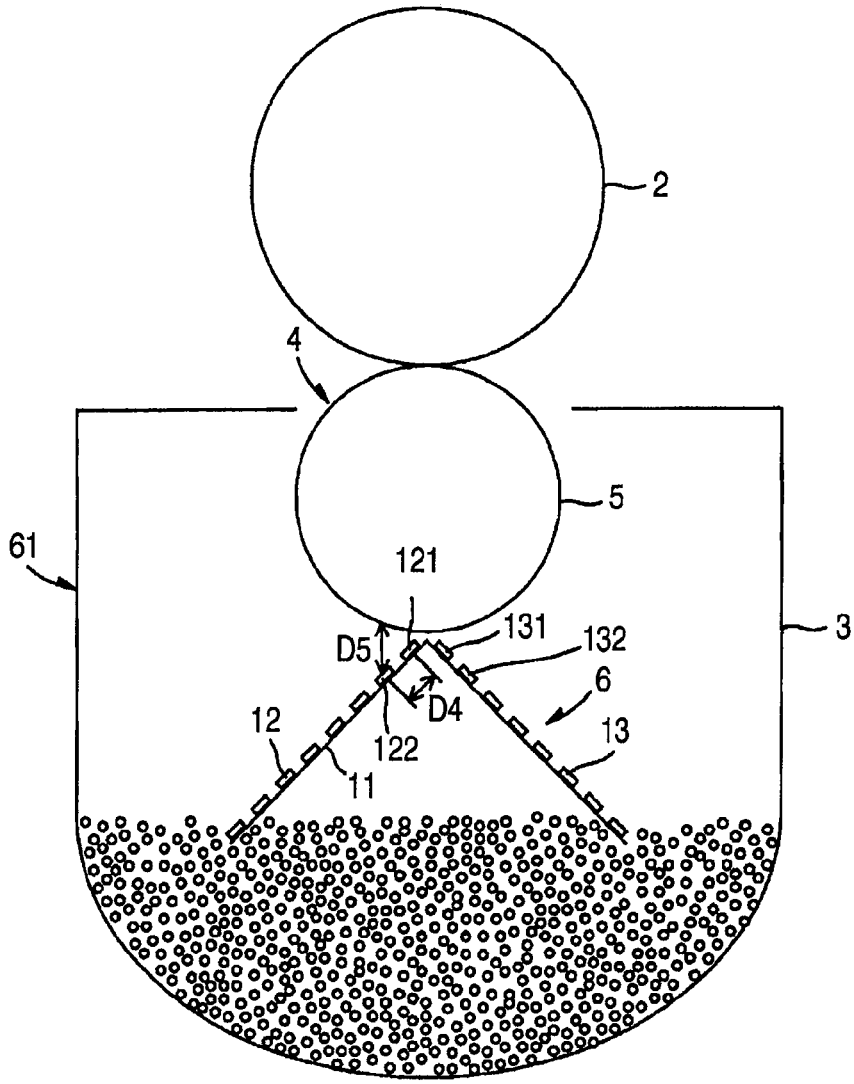
FIG. 6 is a cross section illustrating a configuration of a toner supply device according to a third embodiment.

Hereafter, a toner supply device 61 according to a third embodiment is explained with reference to FIG. 6. In FIG. 6, to elements which are substantially the same as those of the first embodiment shown in FIG. 1, the same reference numbers are assigned, and explanations thereof will not be repeated for the sake of simplicity. In the following, the explanation focuses on the feature of the third embodiment. In the toner supply device 61, the toner collecting substrate 7 is not provided.

As shown in FIG. 6, the support substrate 11 is formed to extend upward in a slanting direction from the bottom portion of the casing 3 to reach a portion near to the lowermost point of the outer circumferential surface of the development roller 5, and to bend downward in a slanting direction so that an end of the support substrate 11 reaches the bottom portion of the casing 3. That is, the support substrate 11 includes two slanting parts respectively located on both sides with respect to the bending point. The two slanting parts have the same slanting angle.

The electrodes 12 are arranged at constant intervals on one of the slanting parts of the support substrate 11, and the electrodes 13 are arranged at constant intervals on the other of the slanting parts of the support substrate 11.

The distance D4 between the adjacent electrode 122 and the most downstream electrode 121 is smaller than the distance D5 between the adjacent electrode 122 and the development roller 5. Therefore, when a voltage (e.g., 200V) for generating coulomb force attracting the toner toward the development roller 5 is applied to the adjacent electrodes 122 and 132, the toner can be suitably carried from the adjacent electrode 122 to the most downstream electrode 121 and the toner can be suitably carried from the adjacent electrode 132 to the most downstream electrode 131 without causing movement of the toner from the adjacent electrodes 121 and 131 to the development roller 5.

Because the support substrate 11 is bent, it is possible to increase the distance between the most downstream electrodes 121 and 131 in regard to the direction of the electrode-electrode electric field in comparison with the case where the support substrate 11 is formed not to bend.

According to the third embodiment, it is possible to achieve the same advantages as those of the first embodiment, excepting the advantage provided by the toner collecting substrate 7.

Since the toner is carried from the two different points in the bottom portion of the casing 3 along the electrodes 12 and the electrodes 13 to the development roll 5, it is also possible to uniformly supply the toner to the development roller 5 in regard to the axial direction of the development roller 5.

That is, if the toner has unevenness in the direction perpendicular to the toner transfer direction in the bottom portion of the casing (i.e., if the surface of the toner is wavy), the toner amount being carried on the electrodes also causes unevenness. In this case, the toner having unevenness in the amount is supplied to the development roller 5, and thereby the toner causes unevenness on the outer circumferential surface of the development roller 5 in regard to the axial direction of the development roller 5.

By contrast, according to the third embodiment, the toner is carried from the two different points in the bottom portion of the casing 3 along the electrodes 12 and the electrodes 13. Therefore, even if the toner being carried on each of the slanting parts of the support substrate 11 has unevenness in the amount of toner in the direction perpendicular to the toner transport direction, the unevenness of the toner amount can be averaged. As a result, it becomes possible to uniformly supply the toner to the outer circumferential surface of the development roller 5, and thereby it becomes possible to prevent the toner from causing unevenness in the amount of toner in the axial direction of the development roller 5.

It should be understood that the toner supply device 51 may be configured to have the toner collecting substrate 7.

Fourth Embodiment

Figure 7:
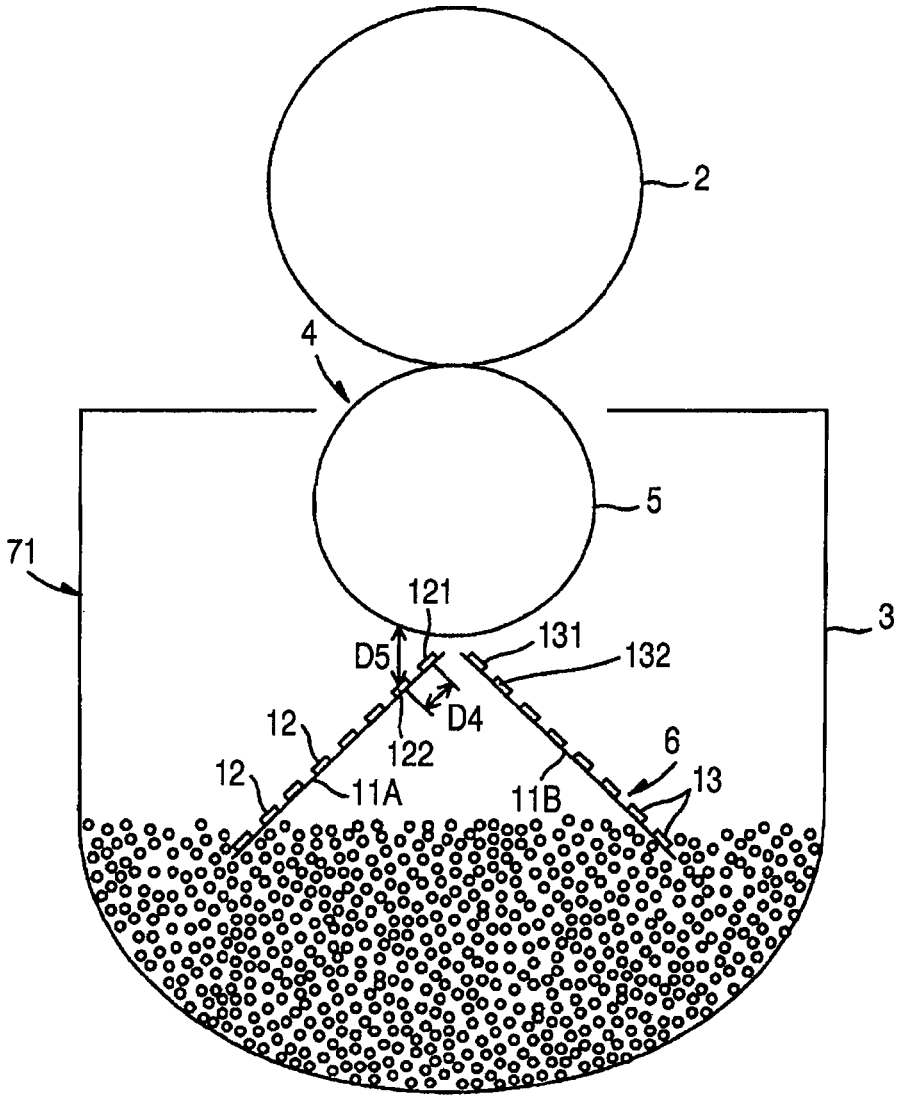
FIG. 7 is a cross section illustrating a configuration of a toner supply device according to a fourth embodiment.

Hereafter, a toner supply device 71 according to a fourth embodiment is explained with reference to FIG. 7. In FIG. 7, to elements which are substantially the same as those shown in FIG. 6, the same reference numbers are assigned, and explanations thereof will not be repeated for the sake of simplicity. In the following, the explanation focuses on the feature of the fourth embodiment. In the toner supply device 71, the toner collecting substrate 7 is not provided.

As shown in FIG. 7, the toner carrying substrate 6 includes two support substrates 11A and 11B. The support substrate 11A is formed to extend upward in a slanting direction from one end located in the bottom portion of the casing 3, and to reach the portion near to the lowermost point of the outer circumferential surface of the development roller 5. The support substrate 11B is formed to be symmetrical with the support substrate 11A with respect to a line passing through the rotation center of the development roller 5 and the lowermost point of the outer circumferential surface of the development roller 5. That is, the support substrate 11B is formed to extend upward in a slanting direction from one end located in the bottom portion of the casing 3, and to reach the portion near to the lowermost point of the outer circumferential surface of the development roller 5.

The electrodes 12 are arranged at constant intervals on the support substrate 11A, and the electrodes 13 are arranged at constant intervals on the support substrate 11B.

According to the fourth embodiment, it is possible to achieve the same advantages as those of the toner supply device 61 shown in FIG. 6. That is, according to the fourth embodiment, it is possible to achieve the same advantages as those of the first embodiment, excepting the advantage provided by the toner collecting substrate 7.

Since the toner is carried from the two different positions in the bottom portion of the casing 3 along the electrodes 12 and the electrodes 13 and the toner is supplied to the outer circumferential surface of the development roller 5 without causing unevenness in the amount of toner, it is also possible to uniformly supply the toner to the outer circumferential surface of the development roller 5 in the axial direction of the development roller 5.

It should be noted that each of the support substrates 11A and 11B may be formed to have the same structure as that of the support substrate 11 shown in FIG. 2. Alternatively, each of the support substrates 11A and 11B may be formed by omitting, from the structure shown in FIG. 2, one resin layer 14 on which the electrodes 12 and 13 are not provided. The toner supply device 71 may include the toner collecting substrate 7.

Fifth Embodiment

Figure 8:
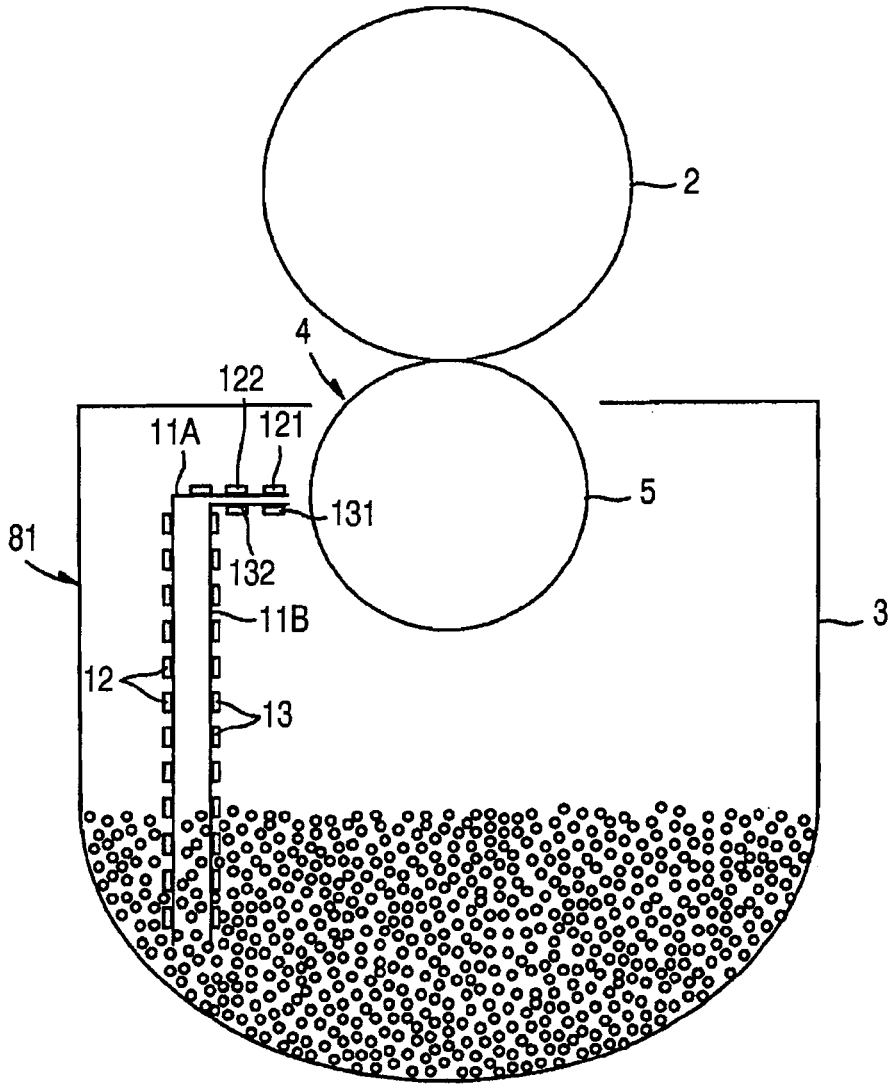
FIG. 8 is a cross section illustrating a configuration of a toner supply device according to a fifth embodiment.

Hereafter, a toner supply device 81 according to a fifth embodiment is explained with reference to FIG. 8. In FIG. 8, to elements which are substantially the same as those of the first embodiment shown in FIG. 1, the same reference numbers are assigned, and explanations thereof will not be repeated for the sake of simplicity. In the following, the explanation focuses on the feature of the fifth embodiment. In the toner supply device 81, the toner collecting substrate 7 is not provided.

As shown in FIG. 8, the toner carrying substrate 6 includes two support substrates 11A and 11B. The support substrates 11A and 11B extend upward from the bottom portion of the casing 3 while forming a constant interval therebetween, and bend at midway points toward the development roller 5 in the horizontal direction so that ends thereof faces the development roller 5.

The electrodes 12 are arranged at constant intervals on a surface of the support substrate 11A which forms an upper surface at the portion near to the development roller 5, and the electrodes 13 are arranged at constant intervals on a surface of the substrate 11B which forms an lower surface at the portion near to the development roller 5. It should be noted that the positions of the most downstream electrodes 121 and the 131 of the toner supply device 81 shown in FIG. 8 are equivalent to the positions of the most downstream electrodes 121 and 131 of the toner supply device 1 shown in FIG. 1.

According to the fifth embodiment, it is possible to achieve the same advantages as those of the first embodiment, excepting the advantage provided by the toner collecting substrate 7.

It should be noted that each of the support substrates 11A and 11B may be formed to have the same structure as that of the support substrate 11 shown in FIG. 2. Alternatively, each of the support substrates 11A and 11B may be formed by omitting, from the structure shown in FIG. 2, one resin layer 14 on which the electrodes 12 and 13 are not provided. The toner supply device 81 may include the toner collecting substrate 7.

Sixth Embodiment

Figure 9:
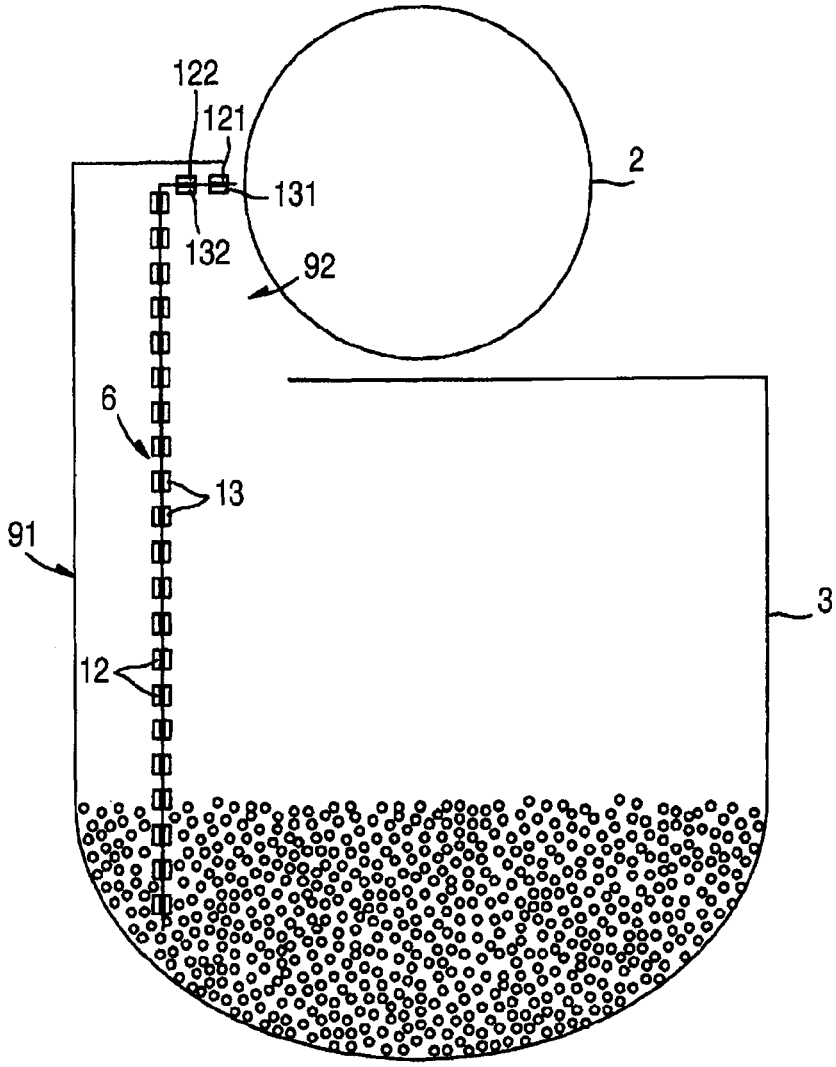
FIG. 9 is a cross section illustrating a configuration of a toner supply device according to a sixth embodiment.

Hereafter, a toner supply device 91 according to a sixth embodiment is explained with reference to FIG. 9. In FIG. 9, to elements which are substantially the same as those of the first embodiment shown in FIG. 1, the same reference numbers are assigned, and explanations thereof will not be repeated for the sake of simplicity. In the following, the explanation focuses on the feature of the sixth embodiment. In the toner supply device 91, the toner collecting substrate 7 is not provided.

As shown in FIG. 9, the toner supply device 91 does not have the development roller 5. At the top of the toner supply device 91, an opening 92 is formed to face the photosensitive drum 2 in a lateral direction. The toner carrying substrate 6 is formed to extend upward from the bottom portion of the casing 3, and to bend at a midway point toward the photosensitive drum 2 so that an end thereof faces the outer circumferential surface of the photosensitive drum 2 in the horizontal direction through the opening 92.

In the toner supply device 91, by applying the voltage to the toner carrying substrate 6, the traveling electric field is generated along the toner carrying substrate 6. Through the traveling electric field, the toner stored in the bottom portion of the casing 3 is carried toward the photosensitive drum 2. The toner which has carried to the end of the toner carrying substrate 6 moves from the toner carrying substrate 6 to the outer circumferential surface of the photosensitive drum 2. As a result, the toner can be successfully supplied to the outer circumferential surface of the photosensitive drum 2, and the image development from an electrostatic latent image formed on the outer circumferential surface of the photosensitive drum 2 to a toner image can be achieved. Since the toner can be uniformly supplied to the outer circumferential surface of the photosensitive drum 2, it is possible to suitably achieve the image development from an electrostatic latent image to a toner image.

Although the present invention has been described in considerable detail with reference to certain preferred embodiments thereof, other embodiments are possible.

In the above described embodiment, the phase of the voltage change of the most downstream electrode 12 has the complete inversed relationship with the phase of the voltage change of the most downstream electrode 13. However, the phase of the voltage change of the most downstream electrode 12 does not necessarily have the complete inversed relationship with the phase of the voltage change of the most downstream electrode 13. That is, by setting the phase of the voltage change of the most downstream electrode 12 and the phase of the voltage change of the most downstream electrode 13 to become different from each other, it is possible to apply the voltages (e.g., 200V) for generating the coulomb force attracting the toner to the development roller 5 at different times with respect to the most downstream electrodes 121 and 131, respectively. Therefore, it is possible to set the timing at which the toner is supplied from the most downstream electrode 121 to the development roller 5 and the timing at which the toner is supplied from the most downstream electrode 131 to the development roller 5 to shift with respect to each other. As a result, it becomes possible to shorten the time period in which the toner is not supplied to the development roller 5 or the photosensitive drum 2. Therefore, it is possible to reduce unevenness in the amount of toner caused on the development roller 5 or the photosensitive drum 2.

In the support substrate 11 shown in FIG. 2, the shield layer 15 is provided between the two resin layers 14. However, the shield layer 15 may be omitted as long as an undesired electric field is not generated between the electrode 12 and the electrode 13. For example, if each electrode 12 provided on one side of the support substrate 11 and each electrode 13 provided on the other side of the support substrate 11 face with each other by positioning them not to shift with respect to each other in the toner transport direction, the shield layer 15 may be omitted. If the electrode 12 and the electrode 13 shift with respect to each other only in a part of the support substrate 11, the shield layer 15 may be provided only in the part of the support substrate 11.

What is claimed is:

1. A developer supply device for supplying developer to a supply target, comprising:

a casing configured to store the developer;

a first plurality of electrodes located at a first most downstream position and positions between the casing and the first most downstream position to form a first traveling electric field to carry the developer toward the supply target, the first most downstream position being located a predetermined distance from the supply target;

a second plurality of electrodes located at a second most downstream position and positions between the casing and the second most downstream position to form a second traveling electric field different from the first traveling electric field to carry the developer toward the supply target, the second most downstream position being located the predetermined distance from the supply target; and a power circuit configured to supply a first voltage and a second voltage respectively to the first plurality of electrodes and the second plurality of electrodes such that a phase of voltage change of a first most downstream electrode of the first plurality of electrodes located at the first most downstream position and a phase of voltage change of a second most downstream electrode of the second plurality of electrodes located at the second most downstream position shift with respect to each other, and wherein the voltage change of the first voltage and the voltage change of the second voltage have a same frequency.

2. The developer supply device according to claim 1, wherein the power circuit supplies the first voltage and the second voltage such that the phase of the first voltage and the phase of the second voltage have an inversed phase relationship.

3. The developer supply device according to claim 1, wherein a strength of an electric field formed by a potential difference between the first most downstream electrode and the supply target and a strength of an electric field formed by a potential difference between the second most downstream electrode and the supply target are larger than a strength of an electric field formed by a potential difference between the first most downstream electrode and the second most downstream electrode.

4. The developer supply device according to claim 3, wherein:

the first voltage and the second voltage supplied by the power circuit have a same amplitude; and a distance between the first most downstream electrode and the supply target and a distance between the second most downstream electrode and the supply target are smaller than a distance defined between the first and second most downstream electrodes along a direction of the electric field between the first and second most downstream electrodes.

5. The developer supply device according to claim 3, wherein:

a distance between the first most downstream electrode and the supply target and a distance between the second most downstream electrode and the supply target are larger than or equal to a distance defined between the first and second most downstream electrodes in a direction of the electric field between the first and second most downstream electrodes; and the power circuit supplies the first voltage and the second voltage having a waveform whose amplitude is smaller than a potential difference between the first most downstream electrode and the supply target and a potential difference between the second most downstream electrode and the supply target.

6. The developer supply device according to claim 1, further comprising a support substrate formed such that an end of the support substrate faces the casing and extends from the end to approach the supply target, wherein:

the first plurality of electrodes is arranged on one surface of the support substrate; and the second plurality of electrodes is arranged on the other surface of the support substrate.

7. The developer supply device according to claim 6, wherein the first and second most downstream electrodes are located not to shift with respect to each other in a carrying direction of the developer.

8. The developer supply device according to claim 1, further comprising a support substrate formed such that one surface of the support substrate faces the supply target, wherein the first plurality of electrodes and the second plurality of electrodes are arranged on the one surface of the support substrate.

9. The developer supply device according to claim 8, wherein:

the support substrate is formed to bend at a midway point to protrude on a side of the one surface of the support substrate, the support substrate being closest to the supply target at a point where the support substrate is bent;

the first plurality of electrodes is located on one side of the support substrate with respect to the point where the support substrate is bent; and the second plurality of electrodes is located on the other side of the support substrate with respect to the point where the support substrate is bent.

10. The developer supply device according to claim 8, wherein:

a distance between the first most downstream electrode and a first adjacent electrode located adjacent to the first most downstream electrode is shorter than a distance between the first adjacent electrode and the supply target; and a distance between the second most downstream electrode and a second adjacent electrode located adjacent to the second most downstream electrode is shorter than a distance between the second adjacent electrode and the supply target.

11. The developer supply device according to claim 1, further comprising:

a first support substrate provided such that the first plurality of electrodes is arranged on one surface of the first support substrate; and a second support substrate provided such that the second plurality of electrodes is arranged on one surface of the second support substrate, wherein the first and second support substrates are located such that an end of the first support substrate on a side of the first most downstream position and an end of the second support substrate on a side of the second most downstream position are positioned close to each other.

12. The developer supply device according to claim 1, further comprising a shield member provided between the first plurality of electrodes and the second plurality of electrodes to electrically insulate the first plurality of electrodes and the second plurality of electrodes with respect to each other.

13. The developer supply device according to claim 1, further comprising a third plurality of electrodes located at a most upstream position and positions between the casing and the most upstream position to form a third traveling electric field to carry the developer toward the casing by attracting the developer from the supply target, the most upstream position being located a predetermined distance from the supply target.

14. The developer supply device according to claim 1, wherein the supply target includes a development roller formed to hold the developer on an outer circumferential surface of the development roller.

* * * * *